US010166424B2

(12) United States Patent
Chang

(10) Patent No.: US 10,166,424 B2
(45) Date of Patent: Jan. 1, 2019

(54) EXERCISE MACHINE HAVING CHANGEABLE DAMPING MECHANISM

(71) Applicant: Chung-Fu Chang, Changhua County (TW)

(72) Inventor: Chung-Fu Chang, Changhua County (TW)

( * ) Notice: Subject to any disclaimer, the term of this patent is extended or adjusted under 35 U.S.C. 154(b) by 19 days.

(21) Appl. No.: 15/460,332

(22) Filed: Mar. 16, 2017

(65) Prior Publication Data

US 2017/0274237 A1 Sep. 28, 2017

(30) Foreign Application Priority Data

Mar. 25, 2016 (CN) ..... 2016 1 0176848
Mar. 25, 2016 (CN) ..... 2016 1 0178077

(51) Int. Cl.

| | |
|---|---|
| ***A63B 22/02*** | (2006.01) |
| ***A63B 69/16*** | (2006.01) |
| ***A63B 22/06*** | (2006.01) |
| ***A63B 21/00*** | (2006.01) |
| ***A63B 21/005*** | (2006.01) |
| ***A63B 21/008*** | (2006.01) |
| ***A63B 21/22*** | (2006.01) |
| *A63B 71/00* | (2006.01) |

(52) U.S. Cl.

CPC ..... *A63B 21/00069* (2013.01); *A63B 21/005* (2013.01); *A63B 21/0088* (2013.01); *A63B 21/154* (2013.01); *A63B 21/225* (2013.01); *A63B 22/02* (2013.01); *A63B 22/0605* (2013.01); *A63B 2071/0081* (2013.01)

(58) Field of Classification Search

CPC ..... A63B 21/00069; A63B 21/00072; A63B 21/157; A63B 22/02; A63B 23/0464; A63B 21/00058–21/00076

See application file for complete search history.

(56) References Cited

U.S. PATENT DOCUMENTS 3,965,763 A * 6/1976 Wechsler ..... B62M 9/1246 116/28.1
4,412,828 A * 11/1983 Darby ..... B62M 9/12 474/78
5,803,848 A * 9/1998 Nier ..... B62M 25/045 474/81
6,176,817 B1 * 1/2001 Carey ..... A63B 22/18 482/146

(Continued)

*Primary Examiner* — Nyca T Nguyen
(74) *Attorney, Agent, or Firm* — Jackson IPG PLLC; Demian K. Jackson

(57) ABSTRACT

An exercise machine having a changeable damping mechanism is provided. A first transmission rope on a first shifting wheel of a first rotating shaft drives a damping device of a damping shaft to generate a relative damping action for training the leg muscular endurance of the user. Through a first changeable damping mechanism, the first transmission rope, which having stretch elasticity on the first shifting wheel is controlled to adjust the rotational speed according to the gear ratio, which may be in cooperation with a second transmission rope, which having stretch elasticity on a second shifting wheel through a second changeable damping mechanism, and is in cooperation with the damping action of a magnetic control wheel or a blower fan of the damping device to extend the range of damping control for different users to train muscular endurance.

13 Claims, 12 Drawing Sheets

(56) References Cited

U.S. PATENT DOCUMENTS

| | | | | |
|---|---|---|---|---|
| 6,371,891 | B1 * | 4/2002 | Speas | A63B 21/157<br>280/210 |
| 6,394,021 | B1 * | 5/2002 | Caron | B62M 25/04<br>116/28.1 |
| 7,293,789 | B1 * | 11/2007 | Efros | B62M 1/28<br>280/243 |
| 8,550,942 | B2 * | 10/2013 | Oda | B62K 23/06<br>474/80 |
| 9,586,647 | B1 * | 3/2017 | Parker | B62M 1/24 |
| 2006/0160669 | A1 * | 7/2006 | Lizarralde | A63B 21/0051<br>482/63 |
| 2010/0144496 | A1 * | 6/2010 | Schmidt | A63B 21/012<br>482/70 |
| 2012/0258840 | A1 * | 10/2012 | Eisenberg | A63B 22/001<br>482/57 |

* cited by examiner

EXERCISE MACHINE HAVING CHANGEABLE DAMPING MECHANISM

FIELD OF THE INVENTION

The present invention relates to an exercise machine having a changeable damping mechanism, and more particularly to an exercise machine having a changeable damping mechanism which is convenient to adjust damping for different users to train the leg muscular endurance.

BACKGROUND OF THE INVENTION

There are a variety of treadmills on the market. One of the treadmills is a walking treadmill, which provides a flywheel to facilitate the running of the treadmill belt through the reverse thrust exerted by the user on the treadmill belt. The faster the speed of running, the faster the running speed of the runner. Because the flywheel has the gravitational acceleration of rotation, it is unable to stop the running of the treadmill belt quickly if the user wants to stop running. If the user stops running in a quick manner, he/she may have the risk of falling off the treadmill.

In order to solve the aforementioned problems, an electric treadmill is developed. The power of the existing electric treadmill adopts a single motor with a single steering as a power source for traction of the treadmill belt. The power source is a DC motor or an AC frequency conversion motor. However, it is well known that the range of the power provided by the DC motor is limited and it cannot be used indefinitely. Although the range of the power provided the AC frequency conversion motor is wide, the magnetic flux of the rotator is extremely saturated at a very low frequency (low speed). It is difficult to control the AC frequency conversion motor, and even there is the risk of burning. When the AC frequency conversion motor is used at a low frequency, the frequency convertor will automatically reduce the voltage acting on the motor, so that the torque will be reduced greatly. For the AC frequency conversion motor, a constant torque is applied to 120 HZ below, and a constant power is applied to 120 HZ above. Therefore, when the motor is running in the condition of more than 120 HZ high frequency, the motor cannot maintain a high level of torque output, so it limits the range of the power output.

As to the power source of the existing treadmill, no matter which is used (DC motor or AC frequency conversion motor), it is necessary to make a choice for the speed provided. For example, for the use of rehabilitation, the power source must be outputted at a very low speed. For the use of running, the power source must be outputted at a high speed. In order to reduce the restriction caused by the above situation, most of treadmills for rehabilitation adopt an AC frequency conversion motor having a wide range of output, such that it can meet the demands for rehabilitation at a very low speed and the demands for fitness and exercise at a high speed.

The aforesaid existing treadmill has to use a motor for driving the treadmill belt. A passive electric treadmill used for rehabilitation is developed accordingly. In fact, the walking treadmill is dangerous. The other electric treadmill is used for strengthening cardiopulmonary function only, and it must cooperate with a circuit board, a console and a motor so the relative cost is high. In view of the aforementioned defects, a magnetic treadmill is developed. The magnetic treadmill is provided with a magnetic wheel for damping control, but it cannot control the speed. Besides, it cannot be adjusted for training leg muscular endurance as desired according to the ability of the user. Accordingly, the inventor of the present invention has devoted himself based on his many years of practical experiences to solve these problems.

SUMMARY OF THE INVENTION

The primary object of the present invention is to provide an exercise machine having a changeable damping mechanism. A first transmission rope on a first shifting wheel of a first rotating shaft drives a damping device of a damping shaft to generate a relative damping action for training the leg muscular endurance of the user. Through a first changeable damping mechanism, the first transmission rope on the first shifting wheel is controlled to adjust the rotational speed according to the gear ratio, which may be in cooperation with a second transmission rope on a second shifting wheel through a second changeable damping mechanism, and is in cooperation with the damping action of a magnetic control wheel or a blower fan of the damping device to extend the range of damping control for different users to train muscular endurance. When the user slows his/her pace, through the resistance of the damping device, the treadmill belt can be stopped quickly. This is safe for use. There is no need for motor drive and electric drive for use in various places.

In order to achieve the aforesaid object, an exercise machine having a changeable damping mechanism is provided. The exercise machine comprises a first rotating shaft, a damping device and a first changeable damping mechanism which are disposed at a front end of a main body of the exercise machine. One side of the first rotating shaft is provided with a first shifting wheel. Stepped grooves of different diameters are provided on the first shifting wheel and sized down. The damping device is disposed on a damping shaft. The damping shaft is disposed close to the first rotating shaft and located at the front end of the main body. The first rotating shaft and the damping shaft are disposed on the main body of the exercise machine. The first rotating shaft and the damping shaft are parallel and spaced apart from each other. The first changeable damping mechanism includes a first speed control mechanism disposed close to the first shifting wheel and a first transmission rope. The first transmission rope is wound on the first shifting wheel and the damping shaft. The first speed control mechanism includes a first support, at least one first pull rod, at least one first spring, a first push rod, at least one first pull rope, and a rope fastener. The first support is fixed to the main body. The first pull rod is axially inserted through the first support. A front end of the first pull rod is connected with the first pull rope. A rear end of the first pull rod is sleeved with the first spring. The first push rod is fixed to the rear end of the first pull rod to hold against the first spring. The rope fastener is fixed on the first pull rod to press the first transmission rope wound on the first shifting wheel and the damping shaft. The rope fastener is interlinked with the first push rod. A first knob is connected with the first pull rope for controlling advance of the first pull rod. After released, the push rod biased by the first spring is returned. The first transmission rope is shifted on the stepped grooves with different diameters of the first shifting wheel to provide a rotational speed of different gear ratios to drive the damping device on the damping shaft for damping control, allowing different users to train muscular endurance.

In some embodiments, the exercise machine further comprises a flywheel and a pulley. The flywheel and the pulley are coaxially disposed on one end of the first rotating shaft, far away from the first shifting wheel.

In some embodiments, a front end of the first support is provided with a first front stopper. A rear end of the first support is provided with a first rear stopper. The first pull rod is axially disposed between the first front stopper and the first rear stopper. The front end of the first pull rod penetrates the first front stopper and is connected with the first pull rope. The rear end of the first pull rod penetrates the first rear stopper and is sleeved with the first spring. The first push rod is fixed to the rear end of the first pull rod to hold against the first spring, so that the first spring is located between the first rear stopper and the first push rod.

In some embodiments, the damping device is a magnetic control wheel or a blower fan.

In some embodiments, the exercise machine further comprises at least one second rotating shaft and at least one second changeable damping mechanism. The second rotating shaft is disposed between the first rotating shaft and the damping shaft and parallel to the first rotating shaft and the damping shaft. One side of the second rotating shaft is provided with the second changeable damping mechanism. The second changeable damping mechanism includes a second shifting wheel, a second speed control mechanism, and a second transmission rope. The second speed control mechanism disposed above the second shifting wheel is the same as the first speed control mechanism. The second speed control mechanism includes a second support, a second pull rod, a second spring, a second push rod, and a second pull rope. The first transmission rope is wound on the first shifting wheel and the second rotating shaft. The second transmission rope is wound on the second shifting wheel and the damping shaft. The second pull rope of the second speed control mechanism is connected with a second knob to loosen or tighten the second rope. The second speed control mechanism is in cooperation with the first changeable damping mechanism.

In some embodiments, a plurality of second rotating shafts arranged side by side may be provided between the first rotating shaft and the damping shaft. One side of each second rotating shaft is provided with the second changeable damping mechanism. Wherein, the first transmission rope of the first changeable damping mechanism is wound on the first shifting wheel and the second rotating shaft. The second transmission rope of the second changeable damping mechanism is wound on the second shifting wheel and the adjacent rotating shaft, and is successively wound on the damping shaft. Thereby, the transmission rope of the last changeable damping mechanism is wound with the damping shaft to extend the range of damping control.

In some embodiments, the first changeable damping mechanism is provided with a first knob for pulling the first pull rope.

The effects provided by the present invention are described below. Through the gear ratio of the changeable damping mechanism to adjust the rotational speed, the damping of the damping device can be controlled for different users to train muscular endurance. When the user slows his/her pace, through the resistance of the damping device, the treadmill belt can be stopped quickly. This is safe for use. There is no need for motor drive and electric drive for use in various places.

DESCRIPTION OF THE PREFERRED EMBODIMENTS

Figure 1:
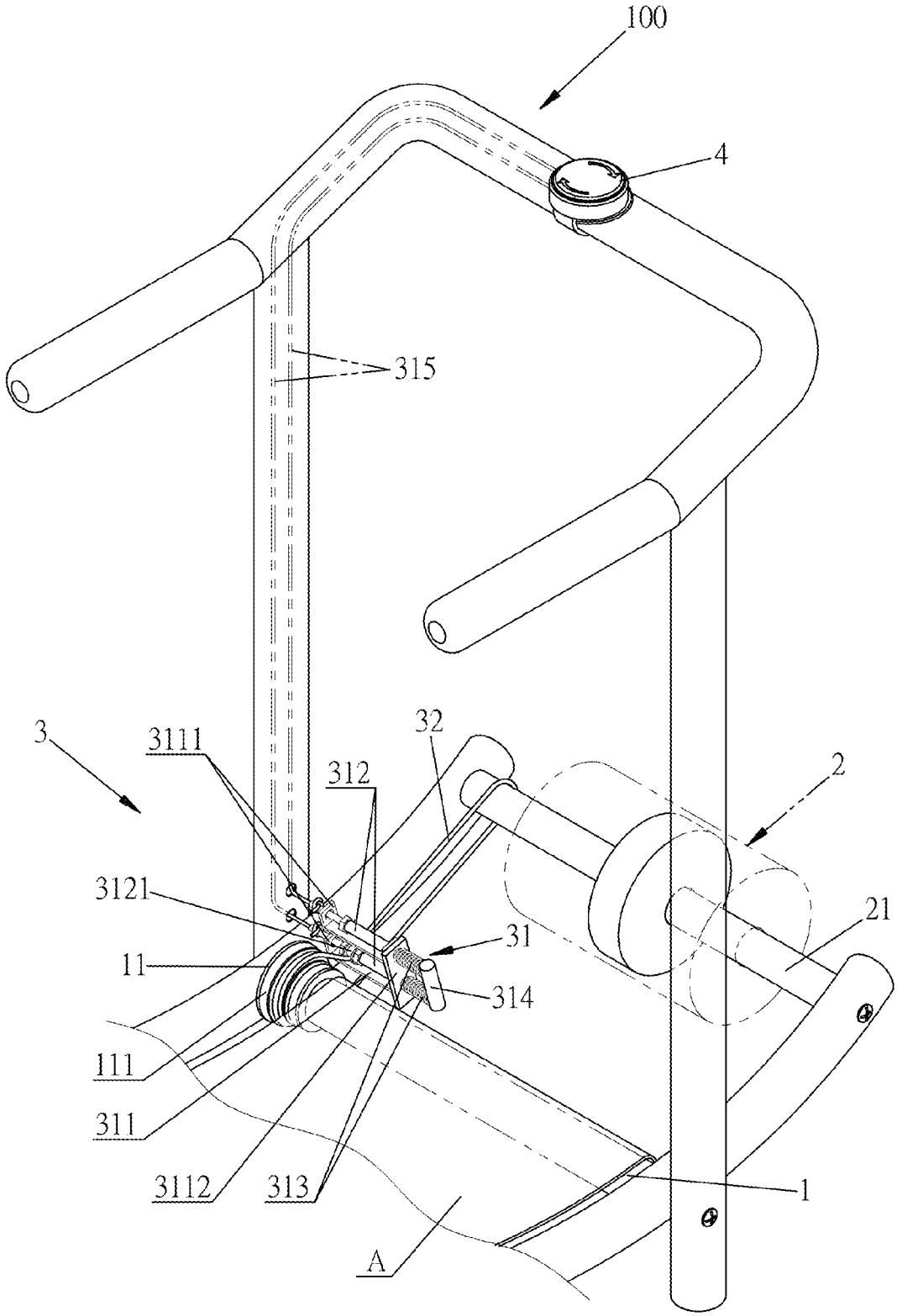
FIG. 1 is a perspective view in accordance with a first embodiment of the present invention.
Figure 2:
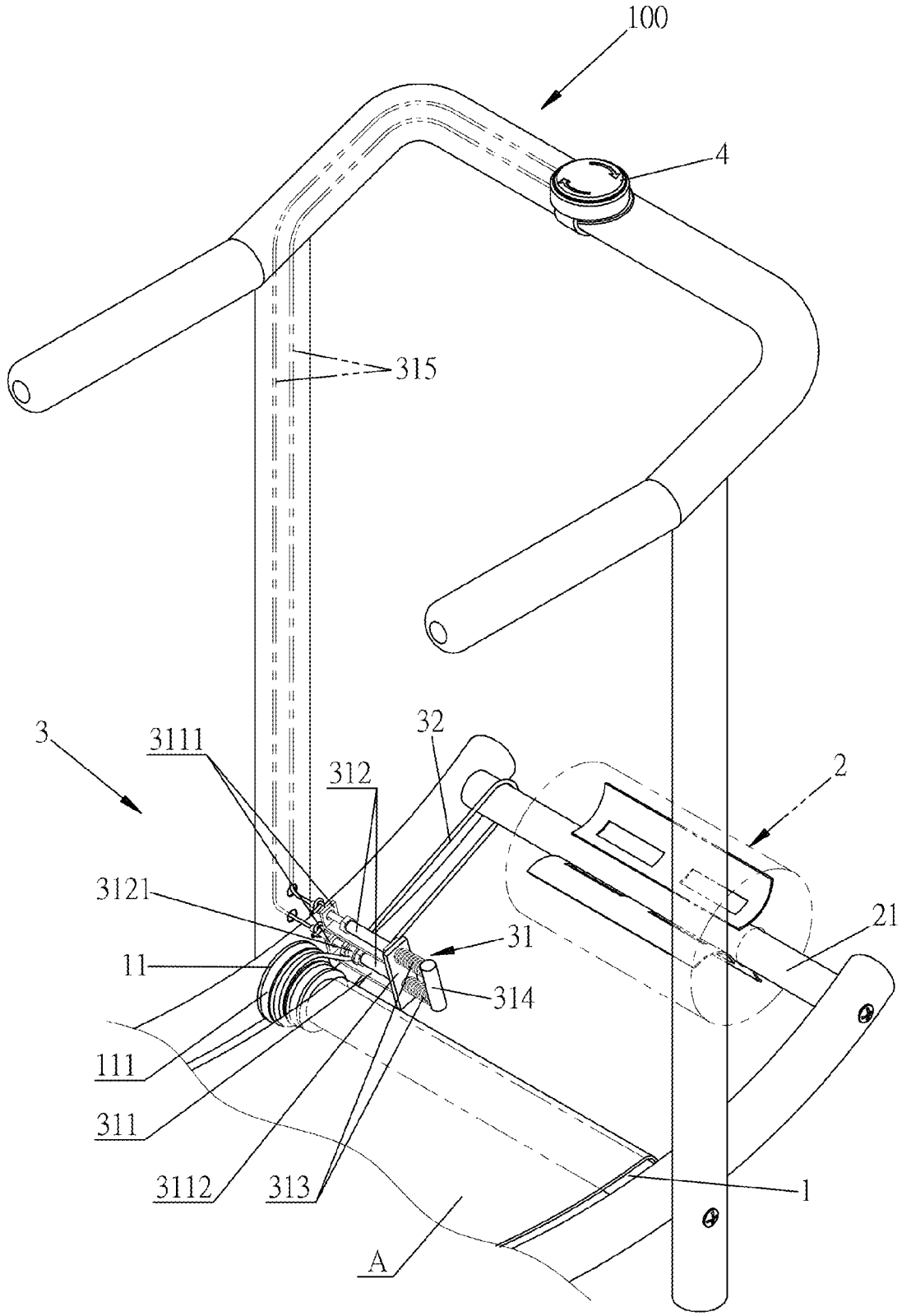
FIG. 2 is a perspective view of the first embodiment of the present invention applied to a treadmill, wherein the damping device is a blower fan.
Figure 3:
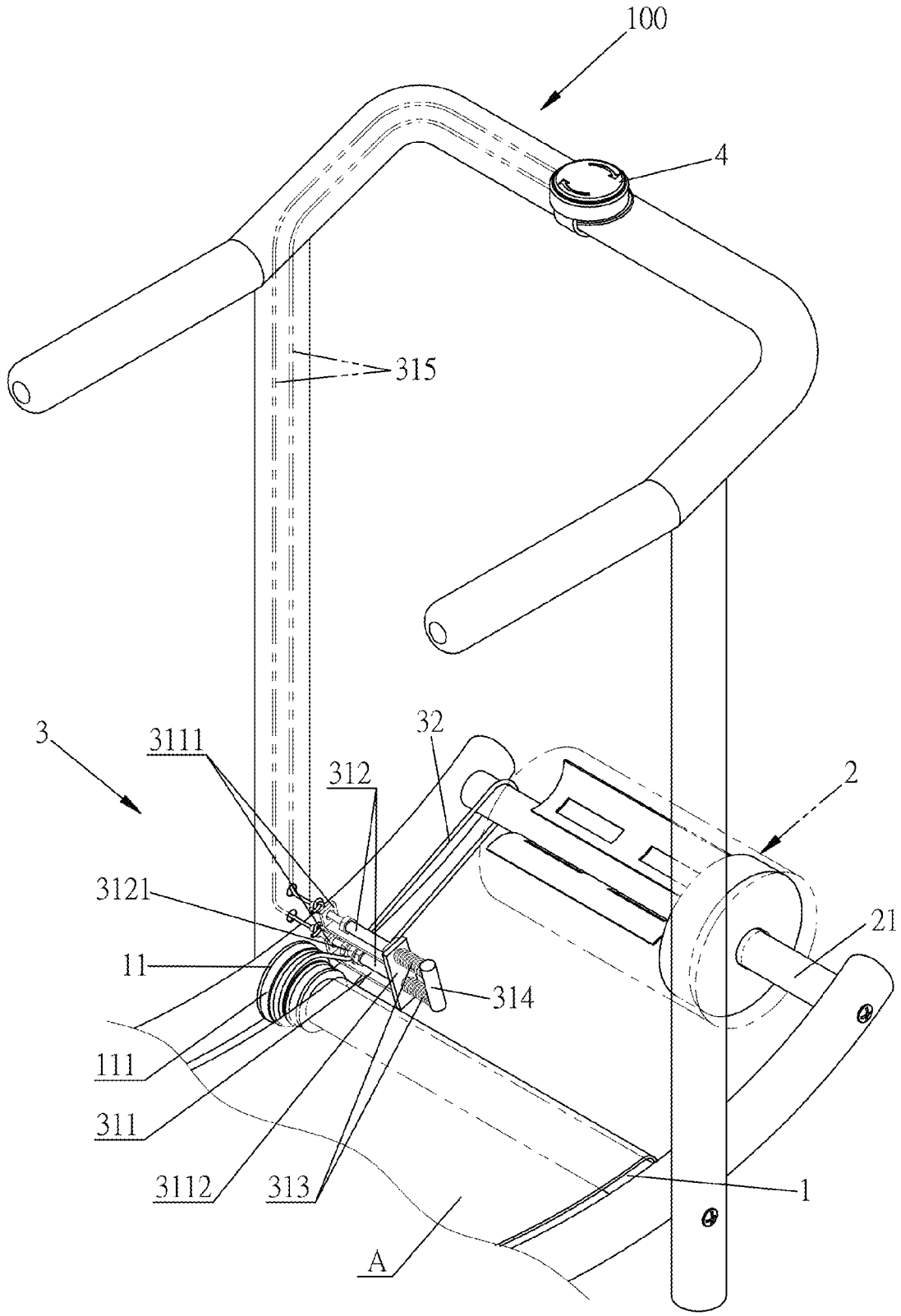
FIG. 3 is a perspective view of the first embodiment of the present invention applied to a treadmill, wherein the damping device is a combination of a flywheel and a blower fan.
Figure 4:
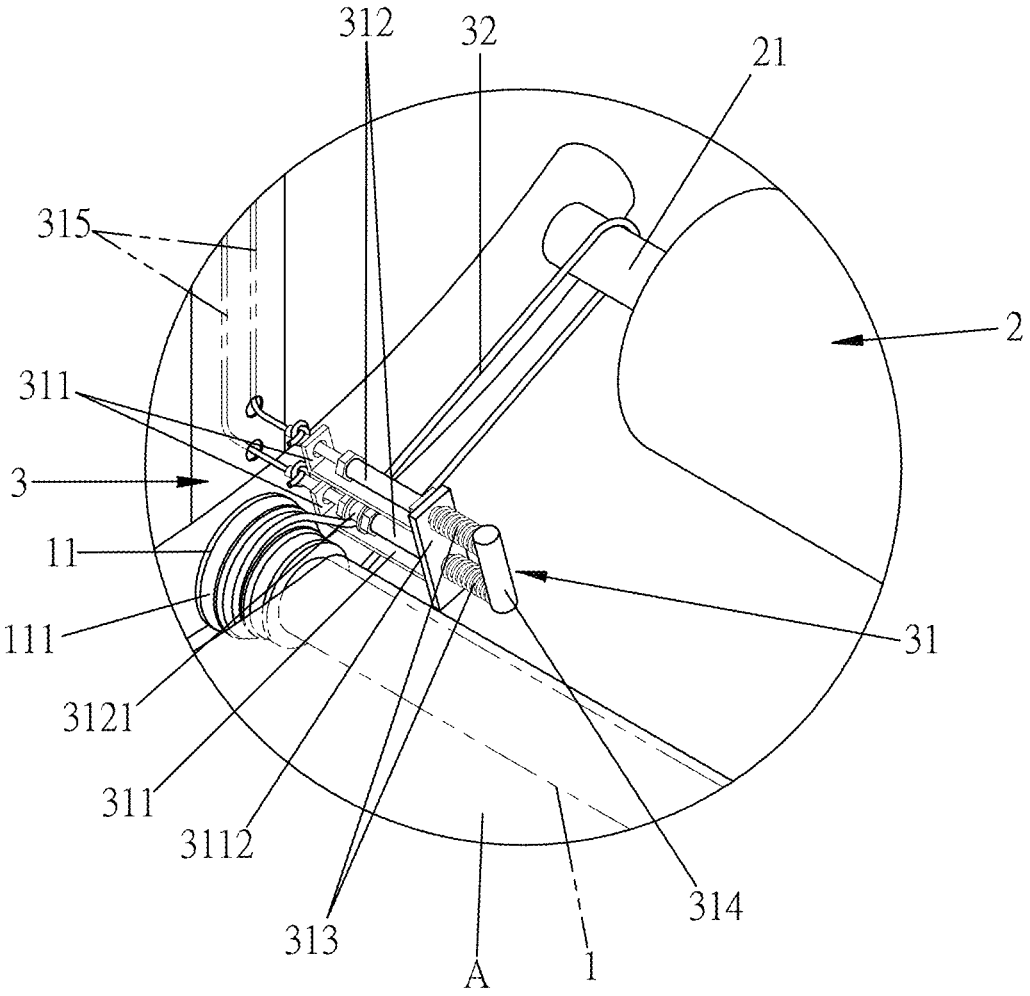
FIG. 4 is a partial enlarged view showing the first changeable damping mechanism in accordance with the first embodiment of the present invention.
Figure 5:
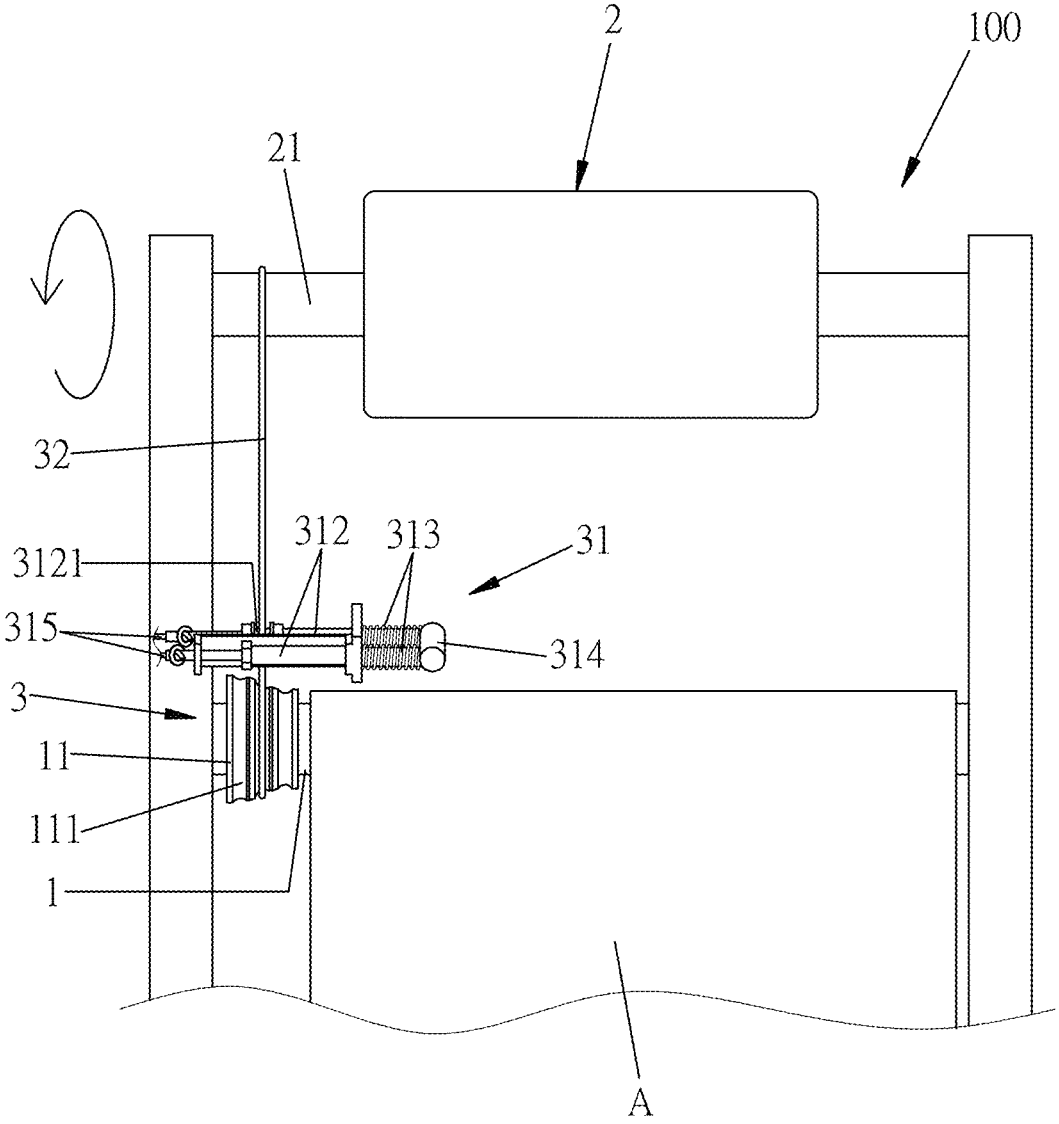
FIG. 5 is a top view in accordance with the first embodiment of the present invention.

Advantages and features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein.

Referring to FIG. 1 through FIG. 5, the present invention discloses an exercise machine having a changeable damping mechanism. The exercise machine comprises a first rotating shaft 1, a damping device 2, and a first changeable damping mechanism 3 which are disposed at a front end of a main body 100 of the exercise machine.

One side of the first rotating shaft 1 is provided with a first shifting wheel 11. Stepped grooves 111 of different diameters are provided on the first shifting wheel 11 and sized down.

The damping device 2 is disposed on a damping shaft 21. The damping shaft 2 is disposed close to the first rotating shaft 1 and located at the front end of the main body 100. The first rotating shaft 1 and the damping shaft 21 are disposed on the main body 100 of the exercise machine, and both are parallel and spaced apart from each other.

The first changeable damping mechanism 3 includes a first speed control mechanism 31 disposed close to the first shifting wheel 11 and a first transmission rope 32. The first transmission rope 32 which having stretch elasticity, it is wound on the first shifting wheel 11 and the damping shaft 21. The first speed control mechanism 31 includes a first support 311, at least one first pull rod 312, at least one first spring 313, a first push rod 314, at least one first pull rope 315, and a rope fastener 3121. A front end of the first support 311 is provided with a first front stopper 3111, and a rear end of the first support 311 is provided with a first rear stopper 3112. The first pull rod 312 is axially disposed between the first front stopper 3111 and the first rear stopper 3112. A front end of the first pull rod 312 penetrates the first front stopper 3111 and is connected with the first pull rope 315. A rear end of the first pull rod 312 penetrates the first rear stopper 3112 and is sleeved with the first spring 313. The first push rod 314 is fixed to the rear end of the first pull rod 312 to hold against the first spring 313, so that the first spring 313 is located between the first rear stopper 3112 and the first push rod 314. The rope fastener 312 is fixed on the first pull rod 312 to press the first transmission rope 32 wound on the first shifting wheel 11 and the damping shaft 21, and is interlinked with the first push rod 312.

The main body 100 of the exercise machine is further provided with a first knob 4. The first knob 4 is connected with the first pull rope 315 for controlling advance of the first pull rod 312. After released, the push rod 314 biased by the first spring 313 is returned, and the first transmission rope 32 is shifted on the stepped grooves 111 with different diameters of the first shifting wheel 11 to provide a rotational speed of different gear ratios to drive the damping device 2 on the damping shaft 21 for damping control.

Figure 6:
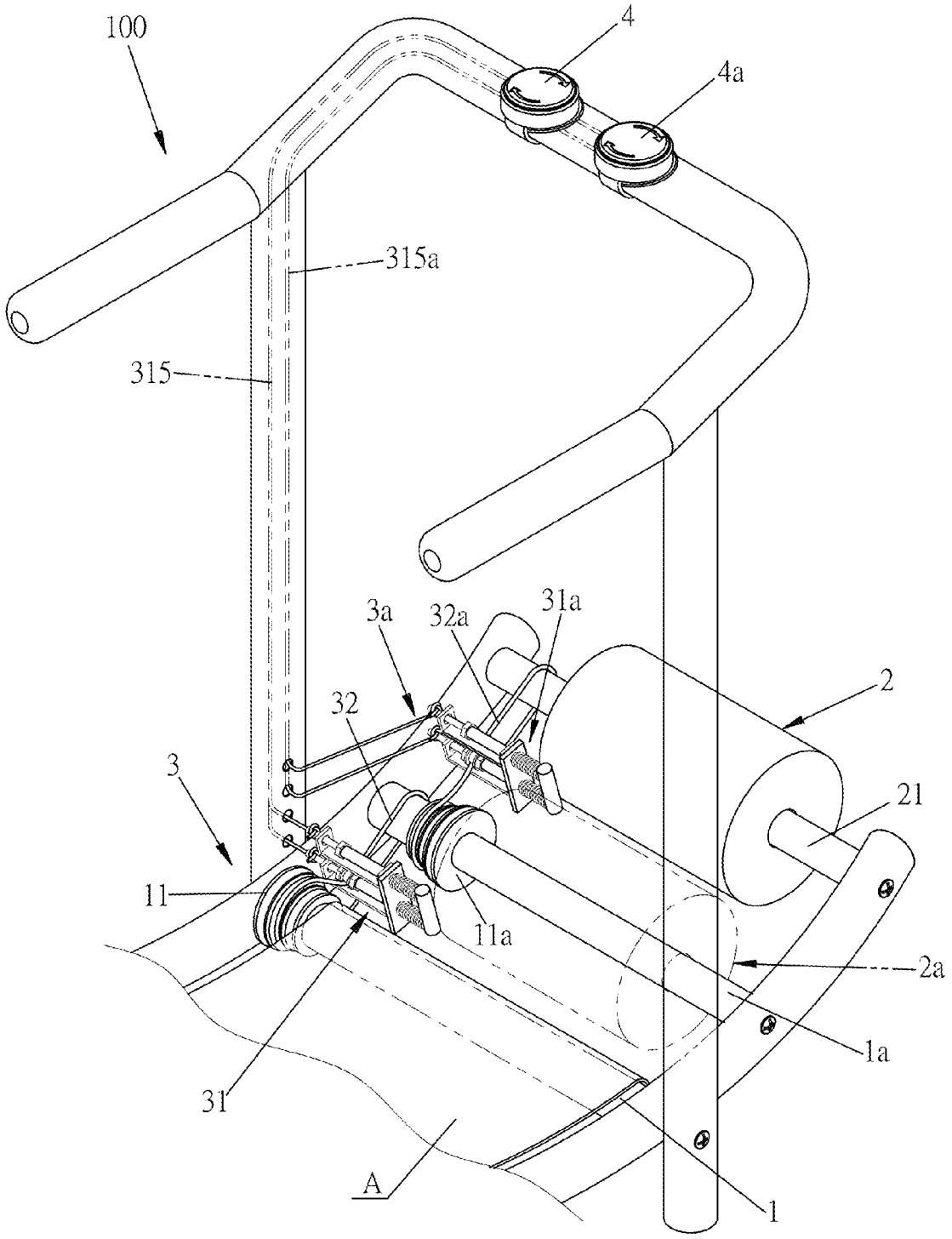
FIG. 6 is a perspective view in accordance with a second embodiment of the present invention, showing the second changeable damping mechanism provided between the first rotating shaft and the damping device.
Figure 7:
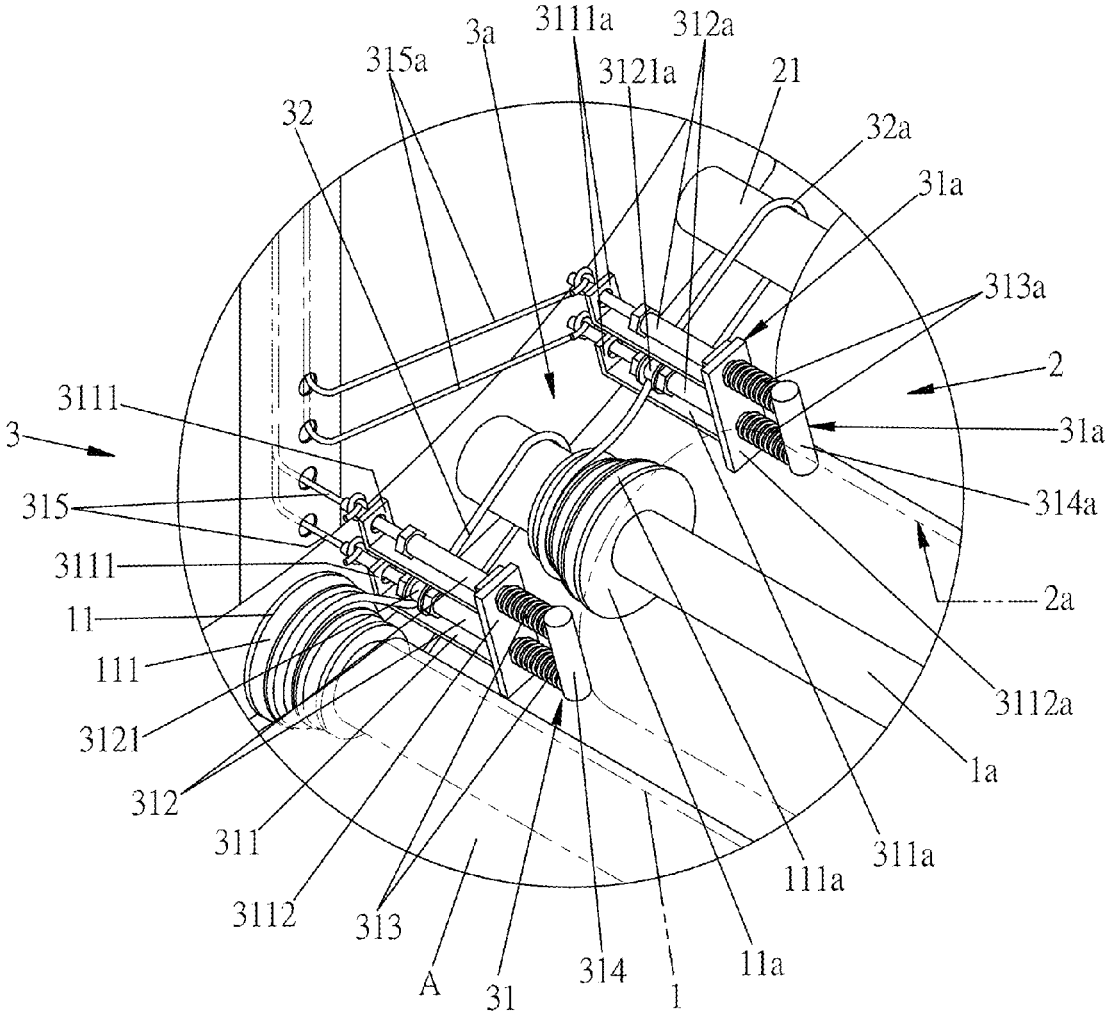
FIG. 7 is a partial enlarged view of FIG. 6.
Figure 8:
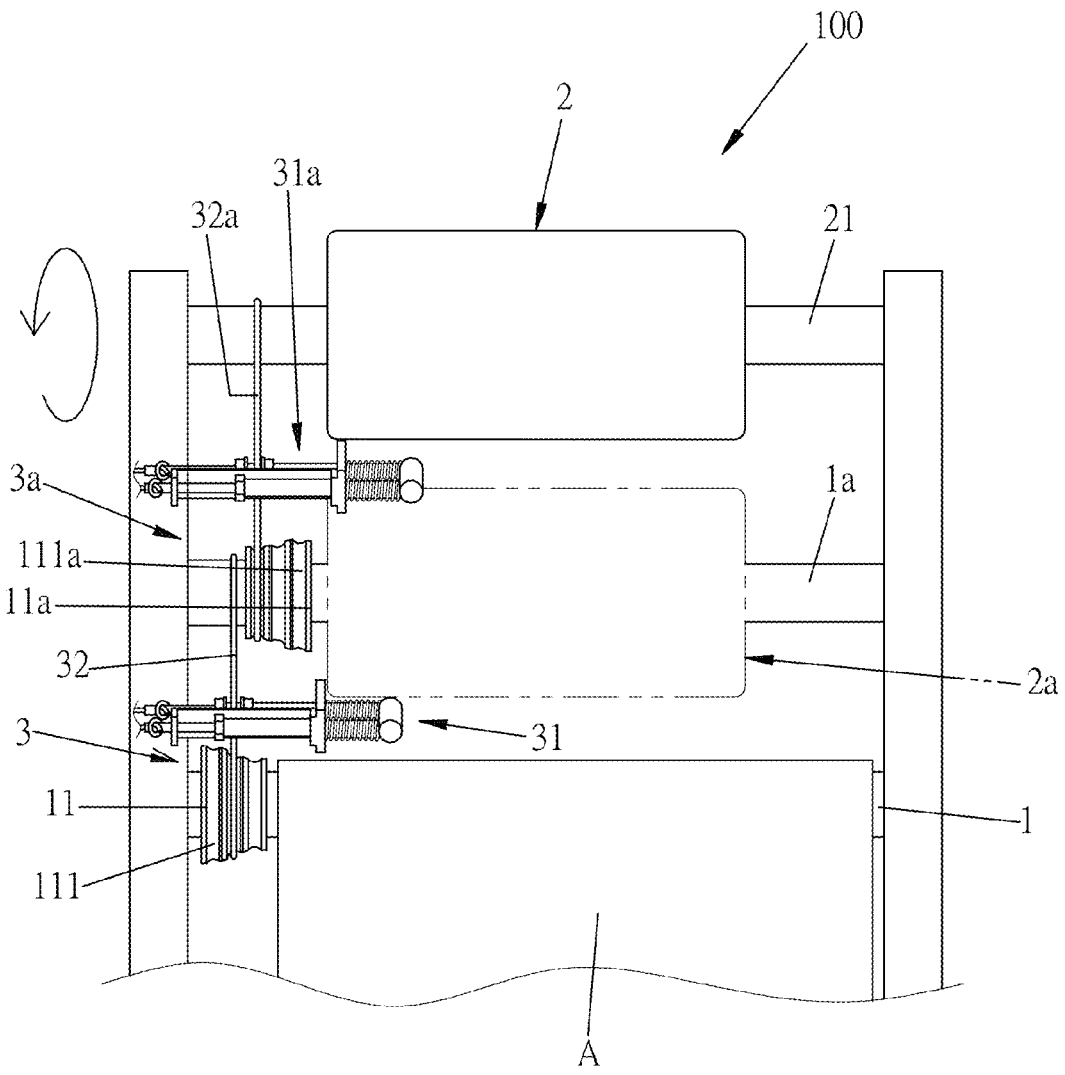
FIG. 8 is a top view of FIG. 6.

Referring to FIGS. 6 to 8, the first changeable damping mechanism 3 further includes at least one second rotating shaft 1*a* and at least one second changeable damping mechanism 3*a*. The second rotating shaft 1*a* is disposed between the first rotating shaft 1 and the damping shaft 21, and is parallel to the first rotating shaft 1 and the damping shaft 21. One side of the second rotating shaft 1*a* is provided with the second changeable damping mechanism 3*a*. The second changeable damping mechanism 3*a* includes a second shifting wheel 11*a*, a second speed control mechanism 31*a*, and a second transmission rope 32*a* which having stretch elasticity. The second speed control mechanism 31*a* disposed above the second shifting wheel 11*a* is the same as the first speed control mechanism 31. The second speed control mechanism 31*a* includes a second support 311*a*, a second pull rod 312*a*, a second spring 313*a*, a second push rod 314*a*, and a second pull rope 315*a*. Wherein, the first transmission rope 32 is wound on the first shifting wheel 11 and the second rotating shaft 1*a*. The second transmission rope 32*a* is wound on the second shifting wheel 11*a* and the damping shaft 21. The second pull rope 315*a* of the second speed control mechanism 31*a* is connected with a second knob 4*a* to loosen or tighten the second pull rope 315*a*, and the second speed control mechanism 31*a* is in cooperation with the first changeable damping mechanism 3 to extend the range of damping control.

In some embodiments, a plurality of second rotating shafts 1*a* arranged side by side may be provided between the first rotating shaft 1 and the damping shaft 21. One side of each second rotating shaft 1*a* is provided with the second changeable damping mechanism 3*a*. Wherein, the first transmission rope 32 of the first changeable damping mechanism 3 is wound on the first shifting wheel 11 and the second rotating shaft 1*a*. The second transmission rope 32*a* of the second changeable damping mechanism 3*a* is wound on the second shifting wheel 1*a* and the adjacent rotating shaft, and is successively wound on the damping shaft 21. Thereby, the transmission rope of the last changeable damping mechanism is wound with the damping shaft 21 to extend the range of damping control.

Furthermore, another damping device 2*a* (as shown in FIG. 6) is provided on the second rotating shaft 1*a*, corresponding to the damping device 2 on the damping shaft 21, to extend the range of damping control.

Referring to FIGS. 1 to 8, the damping device 2 is a magnetic control wheel or a blower fan. In the foregoing embodiment, the damping device 2 is disposed on the damping shaft 21, and is composed of at least one magnetic control wheel and at least one blower fan which are coaxially arranged.

Referring to FIGS. 1 to 8, the first changeable damping mechanism 3 and the second changeable damping mechanism 3*a* are provided with the first knob 4 and the second knob 4*a* to pull the first pull rope 315 and the second pull rope 315*a*, respectively.

Referring to FIGS. 1 to 8, the advantages of the present invention are described below. The first transmission rope 32 on the first shifting wheel 11 of the first rotating shaft 1 drives the damping device 2 of the damping shaft 21 to generate a relative damping action for training the leg muscular endurance of the user. Through the first changeable damping mechanism 3, the first transmission rope 32 on the first shifting wheel 11 is controlled to adjust the rotational speed according to the gear ratio, and is in cooperation with the damping action of the magnetic control wheel or the blower fan of the damping device 2 to extend the range of damping control for different users to train muscular endurance. When the user slows his/her pace, through the resistance of the damping device 2, the treadmill belt A can be stopped quickly. This is safe for use. There is no need for motor drive and electric drive for use in various places. A plurality of rotating shafts and a plurality of changeable damping mechanisms arranged in order are provided between the first rotating shaft 1 and the damping shaft 21 to extend the range of damping control.

Figure 9:
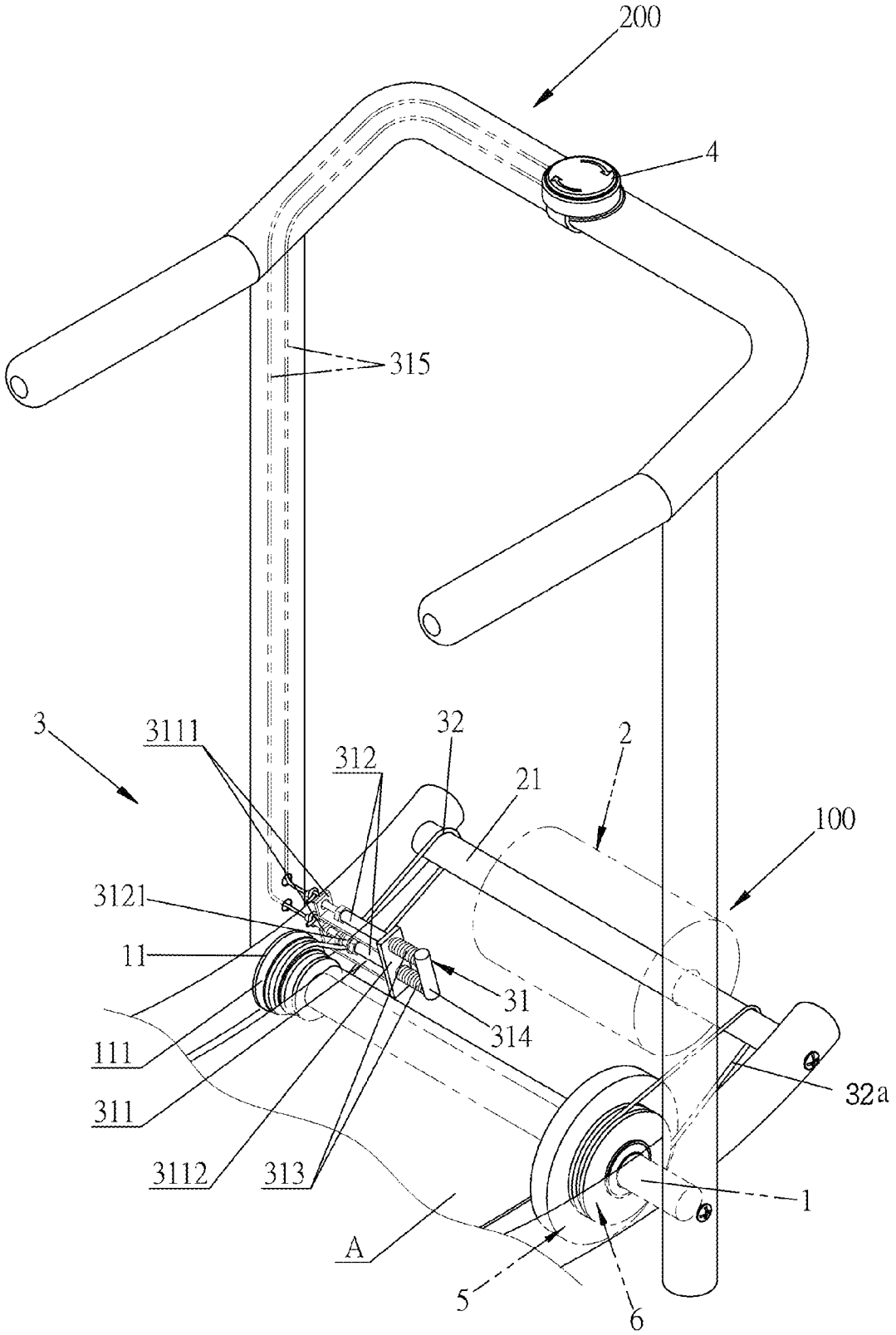
FIG. 9 is a perspective view in accordance with a third embodiment of the present invention, showing the flywheel and the pulley disposed opposite the first shifting wheel.

FIG. 9 illustrates a third embodiment of the present invention. The third embodiment is substantially similar to the first embodiment with the exceptions described hereinafter. One end of the first rotating shaft 1, far away from the first shifting wheel 11, is provided with a flywheel 5 and a pulley 6. A second transmission rope 32*a* is wound on the pulley 6 and the damping shaft 21. Through the driving at both sides, it is more stable when running. The third embodiment also has the same advantages as the first embodiment.

Figure 10:
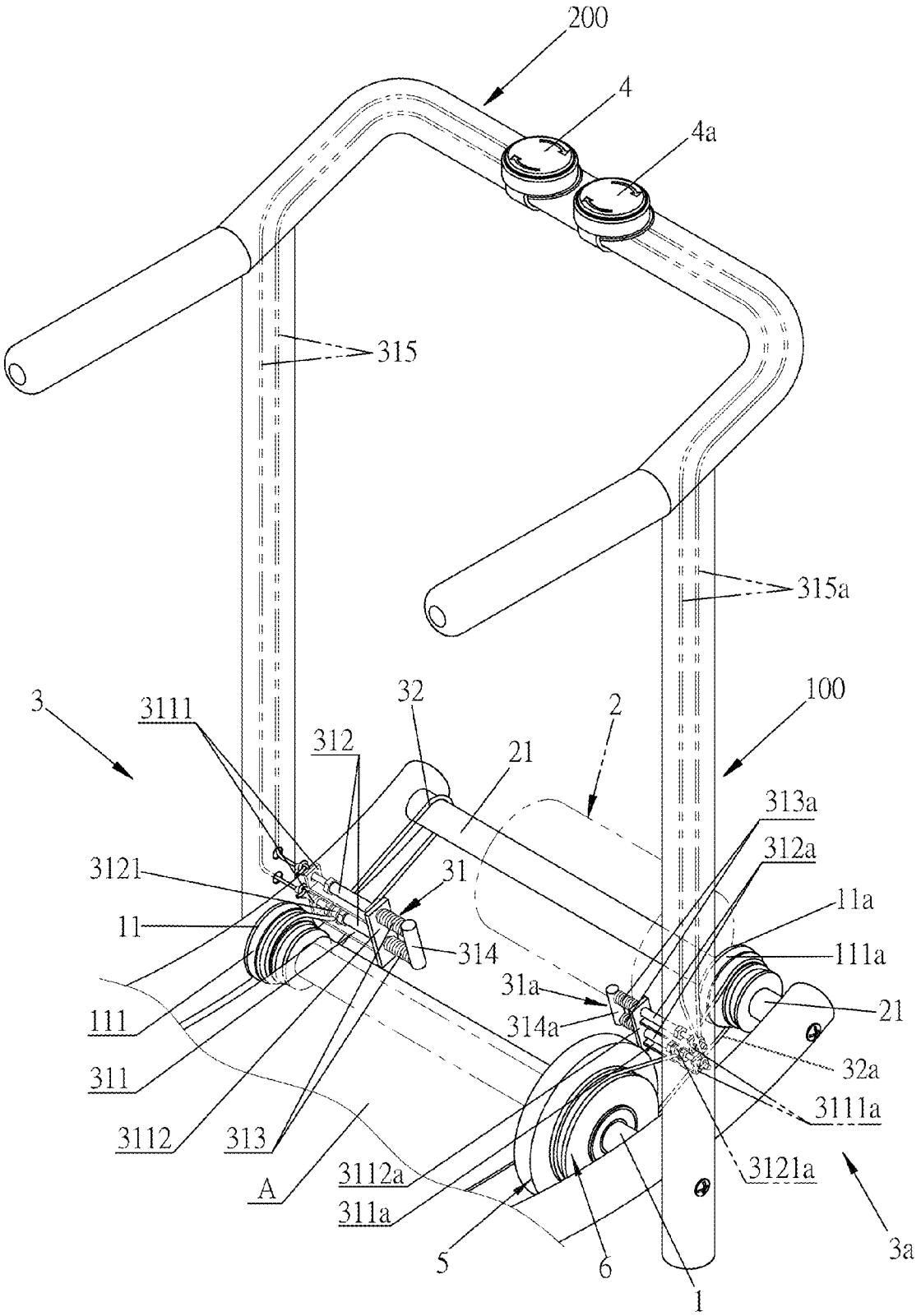
FIG. 10 is a perspective view in accordance with a fourth embodiment of the present invention.

FIG. 10 illustrates a fourth embodiment based on the third embodiment of the present invention. The first changeable damping mechanism 3 further includes a second changeable damping mechanism 3*a* to extend the range of damping control. The second changeable damping mechanism 3*a* is disposed at one side of the damping shaft 21, corresponding to the second transmission rope 32*a*. The second changeable damping mechanism 3*a* includes a second shifting wheel 11*a* and a second speed control mechanism 31*a*. The second shifting wheel 11*a* is coaxially disposed at the side of the damping shaft 21, corresponding to the second transmission rope 32*a*. The second speed control mechanism 31*a* is the same as the first speed control mechanism 31. The second speed control mechanism 31*a* includes a second support 311*a*, a second pull rod 312*a*, at least one second spring 313*a*, at least one second push rod 314*a*, and at least one second pull rope 315*a*. (In the present invention, two first pull rods 312, two first springs 313, and two first pull ropes 315 are provided as an example, but not limited thereto. The following description is for each component.) The second transmission rope 32*a* is wound on the second shifting wheel 11*a* and the pulley 6. The second pull rope 315*a* of the second speed control mechanism 31*a* is connected with a second knob 4*a* provided on the main body 100 of the exercise machine to loosen or tighten the second pull rope 315*a*. The second speed control mechanism 31*a* is in cooperation with the first changeable damping mechanism 3 to extend the range of damping control.

As described in the first and second embodiments, in the third and fourth embodiments, the damping device 2 is a magnetic control wheel or a blower fan. The damping device 2 is disposed on the damping shaft 21, and is composed of at least one magnetic control wheel and at least one blower fan which are coaxially arranged.

Figure 11:
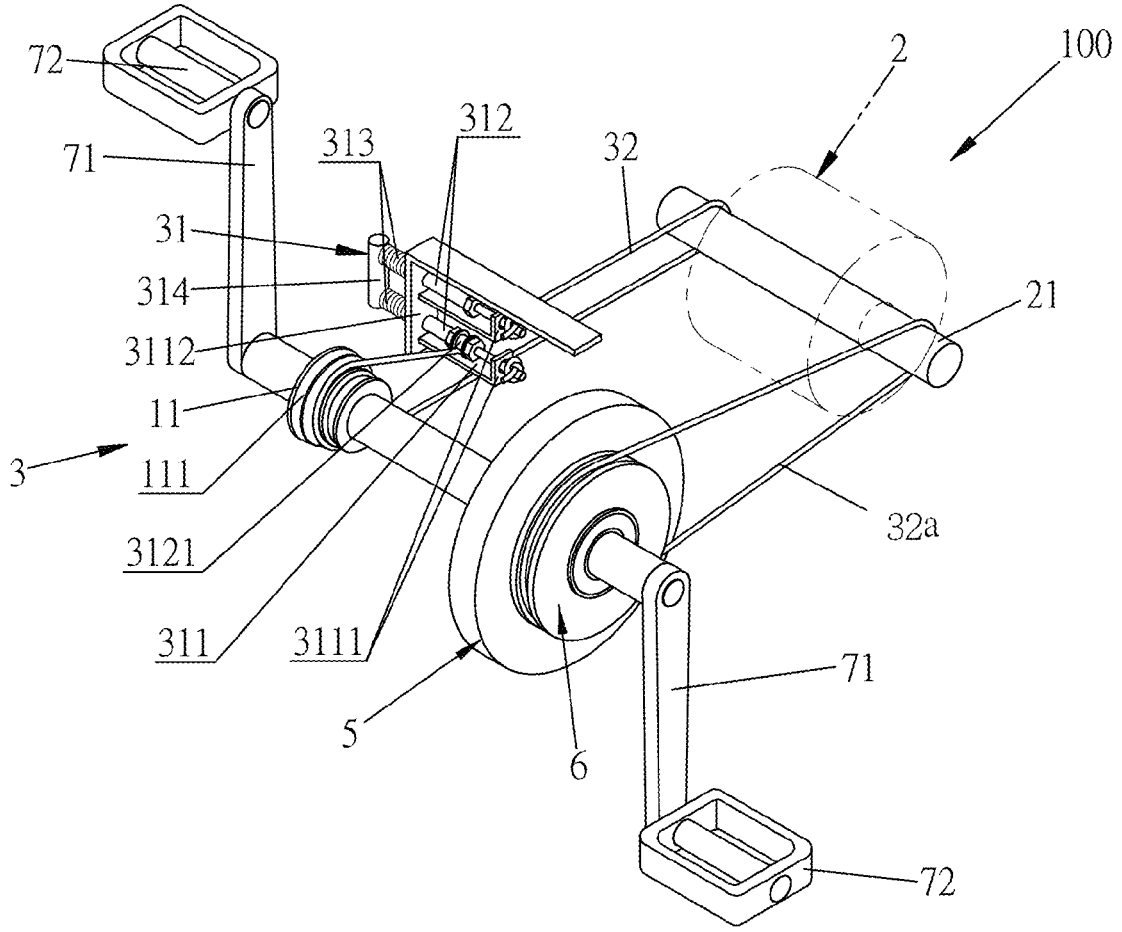
FIG. 11 is a schematic view of the present invention applied to a stationary bike.
Figure 12:
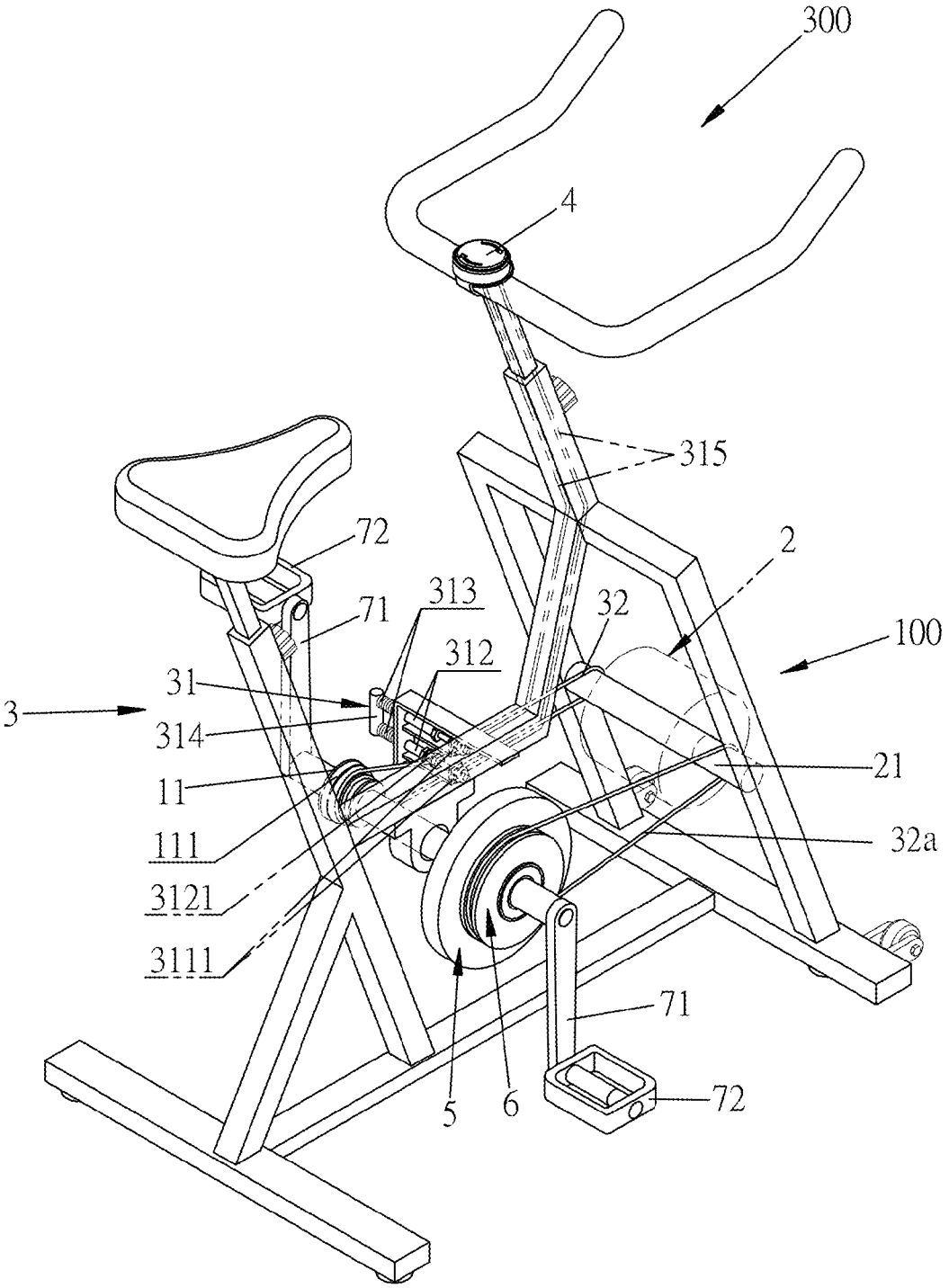
FIG. 12 is a schematic view of FIG. 11 in a use state.

As shown in FIGS. 11 and 12, the changeable damping mechanism of the present invention may be applied to a stationary bike 300, in addition to the treadmill as shown in FIGS. 1 to 10. The structure is the same as the first and second embodiments, so it will not be described again. Two links 71 of the stationary bike 300 are connected to two ends of the first rotating shaft 1, respectively. Two pedals 72 of the stationary bike 300 are each connected to one end of the corresponding link 71, far away from the first rotating shaft 1. The first transmission rope 32 on the first shifting wheel 11 of the first rotating shaft 1 drives the damping device 2 of the damping shaft 21 to generate a relative damping action for training the leg muscular endurance of the user. Through the first changeable damping mechanism 3, the first transmission rope 32 on the first shifting wheel 11 is controlled to adjust the rotational speed according to the gear ratio, which may be in cooperation with the second transmission rope 32*a* on the second shifting wheel 11*a* through the second changeable damping mechanism 3*a*, and is in cooperation with the damping action of the magnetic control wheel or the blower fan of the damping device 2 to extend the range of damping control for different users to train muscular endurance. When the user slows his/her pace, through the resistance of the damping device 2, the treadmill belt A or the links 71/the pedals 72 can be stopped quickly. This is safe for use. There is no need for motor drive and electric drive for use in various places.

The first transmission rope 32 to be needed around the first shifting wheel 11 and the first transmission rope 32, the first transmission rope 32 having stretch elasticity to achieve the transmission effect. The second transmission rope 32*a* also having stretch elasticity. It can really achieve the transmission efficiency, and provide different speed ratio of the speed, driven a damping shaft 21 to control different damping resistance.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An exercise machine having a changeable damping mechanism, the exercise machine comprising a first rotating shaft, a damping device and a first changeable damping mechanism which are disposed at a front end of a main body of the exercise machine, characterized by:

one side of the first rotating shaft being provided with a first shifting wheel, stepped grooves of different diameters being provided on the first shifting wheel and sized down;

the damping device being disposed on a damping shaft, the damping shaft being disposed close to the first rotating shaft and located at the front end of the main body, the first rotating shaft and the damping shaft being disposed on the main body of the exercise machine, the first rotating shaft and the damping shaft being parallel and spaced apart from each other;

the first changeable damping mechanism including a first speed control mechanism disposed close to the first shifting wheel and a first transmission rope, the first transmission rope having stretch elasticity and being wound on the first shifting wheel and the damping shaft; the first speed control mechanism including a first support, at least one first pull rod, at least one first spring, a first push rod, at least one first pull rope, and a rope fastener; the first support being fixed to the main body, the first pull rod being axially inserted through the first support, a front end of the first pull rod being connected with the first pull rope, a rear end of the first pull rod being sleeved with the first spring, the first push rod being fixed to the rear end of the first pull rod to hold against the first spring; the rope fastener being fixed on the first pull rod to press the first transmission rope wound on the first shifting wheel and the damping shaft, the rope fastener being interlinked with the first push rod; and a first knob connected with the first pull rope for controlling advance of the first pull rod;

wherein after released, the push rod biased by the first spring being returned, the first transmission rope being shifted on the stepped grooves with different diameters of the first shifting wheel to provide a rotational speed of different gear ratios to drive the damping device on the damping shaft for damping control.

2. The exercise machine as claimed in claim 1, further comprising a flywheel and a pulley, the flywheel and the pulley being coaxially disposed on one end of the first rotating shaft, away from the first shifting wheel.

3. The exercise machine as claimed in claim 2, wherein the damping device is one of a magnetic control wheel and a blower fan.

4. The exercise machine as claimed in claim 3, wherein the damping device is disposed on the damping shaft, and is composed of at least one magnetic control wheel and at least one blower fan which are coaxially arranged.

5. The exercise machine as claimed in claim 2, wherein a front end of the first support is provided with a first front stopper, a rear end of the first support is provided with a first rear stopper, the first pull rod is axially disposed between the first front stopper and the first rear stopper, the front end of the first pull rod penetrates the first front stopper and is connected with the first pull rope, the rear end of the first pull rod penetrates the first rear stopper and is sleeved with the first spring, and the first push rod is fixed to the rear end of the first pull rod to hold against the first spring so that the first spring is located between the first rear stopper and the first push rod.

6. The exercise machine as claimed in claim 2, further comprising a second changeable damping mechanism, the second changeable damping mechanism being disposed at one side of the damping shaft, corresponding to the second transmission rope, and the second transmission rope having stretch elasticity, the second changeable damping mechanism including a second shifting wheel and a second speed control mechanism, the second shifting wheel being coaxially disposed at the side of the damping shaft, corresponding to the second transmission rope, the second speed control mechanism being the same as the first speed control mechanism, the second speed control mechanism including a second support, a second pull rod, at least one second spring, at least one second push rod, and at least one second pull rope, the second transmission rope being wound on the second shifting wheel and the pulley, the second pull rope of the second speed control mechanism being connected with a second knob provided on the main body of the exercise machine to control the second pull rope, the second speed control mechanism being in cooperation with the first changeable damping mechanism.

7. The exercise machine as claimed in claim 1, wherein the damping device is one of a magnetic control wheel and a blower fan.

8. The exercise machine as claimed in claim 7, wherein the damping device is disposed on the damping shaft, and is composed of at least one magnetic control wheel and at least one blower fan which are coaxially arranged.

9. The exercise machine as claimed in claim 1, further comprising at least one second rotating shaft and at least one second changeable damping mechanism, the second rotating shaft being disposed between the first rotating shaft and the damping shaft and parallel to the first rotating shaft and the damping shaft, one side of the second rotating shaft being provided with the second changeable damping mechanism, the second changeable damping mechanism including a second shifting wheel, a second speed control mechanism, and a second transmission rope which having stretch elasticity; the second speed control mechanism disposed above the second shifting wheel being the same as the first speed control mechanism, the second speed control mechanism including a second support, a second pull rod, a second spring, a second push rod, and a second pull rope; the first transmission rope being wound on the first shifting wheel and the second rotating shaft, the second transmission rope being wound on the second shifting wheel and the damping shaft, the second pull rope of the second speed control mechanism being connected with a second knob to control the second pull rope, the second speed control mechanism being in cooperation with the first changeable damping mechanism.

10. The exercise machine as claimed in claim 9, wherein the at least one second rotating shaft is provided with another damping device corresponding to the damping device on the damping shaft.

11. The exercise machine as claimed in claim 1, wherein a front end of the first support is provided with a first front stopper, a rear end of the first support is provided with a first rear stopper, the first pull rod is axially disposed between the first front stopper and the first rear stopper, the front end of the first pull rod penetrates the first front stopper and is connected with the first pull rope, the rear end of the first pull rod penetrates the first rear stopper and is sleeved with the first spring, and the first push rod is fixed to the rear end of the first pull rod to hold against the first spring so that the first spring is located between the first rear stopper and the first push rod.

12. The exercise machine as claimed in claim 1, wherein the first changeable damping mechanism is provided with the first knob for pulling the first pull rope.

13. The exercise machine as claimed in claim 1, wherein the exercise machine is one of a treadmill and a stationary bike.

* * * * *